US011970802B2

(12) United States Patent
Taninaka et al.

(10) Patent No.: US 11,970,802 B2
(45) Date of Patent: Apr. 30, 2024

(54) FIBROUS NETWORK STRUCTURE HAVING EXCELLENT COMPRESSION DURABILITY

(71) Applicant: TOYOBO CO., LTD., Osaka (JP)

(72) Inventors: Teruyuki Taninaka, Otsu (JP); Shinichi Kobuchi, Osaka (JP); Hiroyuki Wakui, Otsu (JP)

(73) Assignee: TOYOBO CO., LTD., Osaka (JP)

( * ) Notice: Subject to any disclaimer, the term of this patent is extended or adjusted under 35 U.S.C. 154(b) by 973 days.

(21) Appl. No.: 16/918,396

(22) Filed: Jul. 1, 2020

(65) Prior Publication Data

US 2020/0332445 A1 Oct. 22, 2020

Related U.S. Application Data

(63) Continuation of application No. 14/770,696, filed as application No. PCT/JP2013/078449 on Oct. 21, 2013, now abandoned.

(30) Foreign Application Priority Data

Feb. 27, 2013 (JP) ..... 2013-037113
Jun. 4, 2013 (JP) ..... 2013-117715

(51) Int. Cl.
*D04H 3/009* (2012.01)
*D01D 5/24* (2006.01)
(Continued)

(52) U.S. Cl.
CPC ..... *D04H 3/009* (2013.01); *D01D 5/24* (2013.01); *D04H 3/03* (2013.01); *D04H 3/16* (2013.01);
(Continued)

(58) Field of Classification Search
CPC ..... D04H 3/009; D04H 3/03; D04H 3/16; D01D 5/24
See application file for complete search history.

(56) References Cited

U.S. PATENT DOCUMENTS 4,952,265 A 8/1990 Yamanaka et al.
5,639,543 A 6/1997 Isoda et al.
(Continued)

FOREIGN PATENT DOCUMENTS

EP 1 082 480 B1 3/2001
EP 1 832 675 A1 9/2007
(Continued)

OTHER PUBLICATIONS

International Search Report dated Dec. 10, 2013, issued in counterpart application No. PCT/JP2013/078449 (2 pages).
(Continued)

*Primary Examiner* — Mathieu D Vargot
(74) *Attorney, Agent, or Firm* — WHDA, LLP

(57) ABSTRACT

The present invention provides a network structure having excellent repeated compression durability, the network structure having a low repeated compression residual strain and a high hardness retention after repeated compression.

A network structure comprising a three-dimensional random loop bonded structure obtained by forming random loops with curling treatment of a continuous linear structure including a polyester-based thermoplastic elastomer and having a fineness of not less than 100 dtex and not more than 60000 dtex, and by making each loop mutually contact in a molten state, wherein the network structure has an apparent density of 0.005 g/cm$^3$ to 0.20 g/cm$^3$, a 50%-constant displacement repeated compression residual strain of not more than 15%, and a 50%-compression hardness retention of not less than 85% after 50%-constant displacement repeated compression.

3 Claims, 1 Drawing Sheet

(51) Int. Cl.

| | |
|---|---|
| ***D04H 3/03*** | (2012.01) |
| ***D04H 3/16*** | (2006.01) |
| *D01D 5/253* | (2006.01) |
| *D01F 6/86* | (2006.01) |

(52) U.S. Cl.
CPC ..... *D01D 5/253* (2013.01); *D01F 6/86* (2013.01); *D10B 2331/04* (2013.01)

(56) References Cited

U.S. PATENT DOCUMENTS

| | | | | |
|---|---|---|---|---|
| 6,378,150 | B1 | 4/2002 | Minegishi et al. | |
| 2008/0146763 | A1 | 6/2008 | Yamanaka et al. | |
| 2013/0161858 | A1 | 6/2013 | Sasaki | |
| 2015/0087196 | A1* | 3/2015 | Wakui ..... | B68G 11/03 442/328 |

FOREIGN PATENT DOCUMENTS

| | | | |
|---|---|---|---|
| EP | 2 083 100 | A1 | 7/2009 |
| EP | 2 489 770 | A1 | 8/2012 |
| GB | 2275695 | * | 9/1994 |
| JP | 63-256762 | A | 10/1988 |
| JP | 7-68061 | A | 3/1995 |
| JP | 2001-061605 | A | 3/2001 |
| JP | 2001-61605 | A | 3/2001 |
| JP | 3344511 | B2 | 11/2002 |
| JP | 2003-89960 | A | 3/2003 |
| JP | 2003-089960 | A | 3/2003 |
| JP | 2004-244740 | A | 9/2004 |
| JP | 3686691 | B2 | 8/2005 |
| JP | 4164197 | B2 | 10/2008 |
| JP | 2013-090657 | A | 5/2013 |
| JP | 2013-90657 | A | 5/2013 |

OTHER PUBLICATIONS

European Search Report dated Apr. 23, 2014, issued in counterpart application No. EP1400 703.0 (7 pages).
Tanaka, Kenji et al., "High Functional Cushion MAterial BREATH AIR TM", MAterial Report R&D, Feb. 1997, vol. 17, No. 2, pp. 31-36.
Ohyama, Irie, "Airy mattress", Youtube, Aug. 29, 2012, (https://www.youtube.com/watch?v=3k4UflVvWPS.
Bedding product "Airy" to improve the quality of sleep additional 3 items (Bottom Futon, Bottom pad, and cushion) has been release, Information of new products, Iris Ohayama Inc., Mar. 8, 2013, pp. 1-4.
"BreathairTM", Toyobo CO., Ltd., Catalogue, 4 pages.
Test Report:, Kaken Test Center, Jul. 30, 2015, 2 pages.
Summons to attend Oral Proceedings pursuant to Rule 115(1) EPC dated Apr. 24, 2017, issued in counterpart European Patent Application No. 14000703.0. (11 pages).
Hamana, I., "Fiber Formation in Melt-Spinning", Polymer Molecule, 1969, vol. 18, No. 206; w/English translation; cited In European Brief Communication dated Nov. 16, 2017. (18 pages).
Brief Communication dated Nov. 16, 2017, issued in counterpart European Application No. 14000703.0. (9 pages).
Decision of Revoking the European Patent dated Mar. 15, 2018, issued in counterpart European Application No. 14000703.0. (17 pages).
The Minutes of the Oral Proceedings dated Mar. 15, 2018, issued in counterpart European Application No. 14000703.0. (8 pages).
Office Action dated Dec. 7, 2018, issued in counterpart EP Application No. 14000703.0 (21 pages).

* cited by examiner

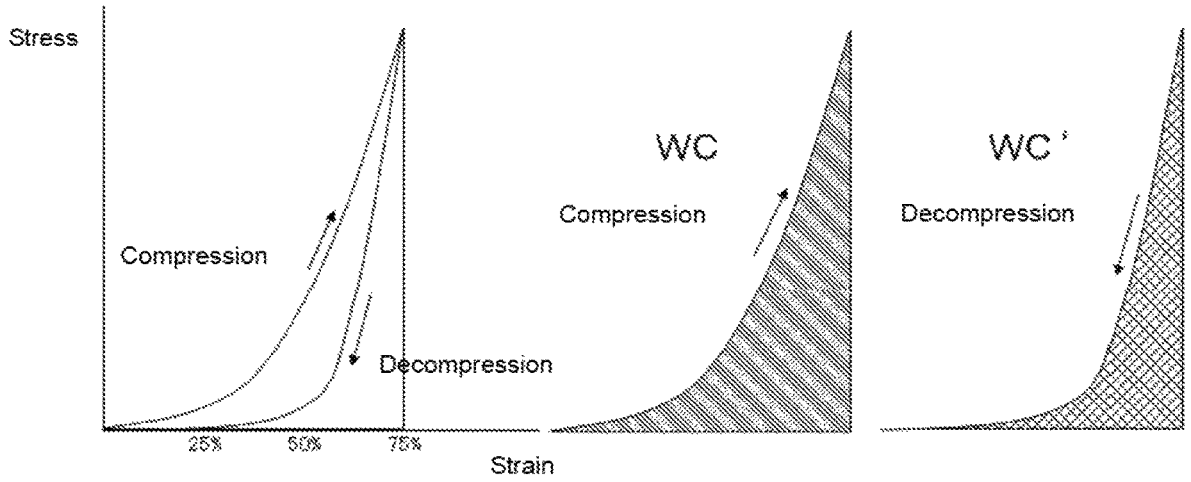
Stress
Compression
Decompression
25%
50%
75%
Strain
WC
Compression
WC '
Decompression

FIBROUS NETWORK STRUCTURE HAVING EXCELLENT COMPRESSION DURABILITY

CROSS-REFERENCE TO RELATED APPLICATIONS

This is a Continuation Application of U.S. application Ser. No. 14/770,696, filed on Aug. 26, 2015, now abandoned, which is a 371 of PCT/JP2013/078449, filed on Oct. 21, 2013, which claims the benefit of priority over Japanese Application No. 2013-037113 filed on Feb. 27, 2013 and Japanese Application No. 2013-117715 filed on Jun. 4, 2013, the entire contents of which are incorporated herein by reference.

TECHNICAL FIELD

The present invention relates to a network structure suitable for cushioning materials that are used for office chairs, furniture, sofas, beddings such as beds, and seats for vehicles such as those for trains, automobiles, two-wheeled vehicles, buggies and child seats, and floor mats and mats for impact absorption such as members for prevention of collision and nipping, etc., the network structure having excellent repeated compression durability.

BACKGROUND ART

At present, foamed-crosslinking type urethanes are widely used a cushioning material that is used for furniture, beddings such as beds, and seats for vehicles such as those for trains, automobiles and two-wheeled vehicles.

Although foamed-crosslinking type urethanes have excellent durability as a cushioning material, they have inferior moisture and water permeability and air permeability, and have thermal storage property to exhibit possible humid feeling. Since the foamed-crosslinking type urethanes do not have thermoplasticity, they have difficulty in recycling, and therefore they give significant damage to incinerators in case of incineration, and need high costs in elimination of poisonous gas. For this reason, the foamed-crosslinking type urethanes are often disposed of by landfill, but limitation of landfill spots based on difficulty of stabilization of ground causes problems of the necessity for higher costs. Furthermore, although the foamed-crosslinking type urethanes have excellent workability, they may cause various problems such as pollution problems with chemicals that have been used in the manufacturing process, residual chemicals after foaming and associated offensive odors.

Patent Documents 1 and 2 disclose network structures. They are capable of solving various problems associated with the foamed-crosslinking type urethanes and have excellent cushioning performance. As for repeated compression durability properties, however, although performance with regard to the repeated compression residual strain is excellent for the 20000-times repeated compression residual strain being not more than 20%, a hardness after repeated use is low for the 50%-compression hardness retention after repeated compression being only about 83%.

Foamed-crosslinking type urethanes have been heretofore considered to have sufficient durability performance if the repeated compression residual strain is low. In recent years, however, it has been increasingly required to secure cushioning performance after repeated use with compression as requirements for repeated compression durability have become higher. However, in regard to the conventional network structures, it is difficult to obtain a network structure having durability performance which satisfies both the requirements of low repeated compression residual strain and high hardness retention after repeated compression.

PRIOR ART DOCUMENTS

Patent Documents

Patent Document 1: Japanese Patent Publication No. H7-68061A

Patent Document 2: Japanese Patent Publication No. 2004-244740A

SUMMARY OF THE INVENTION

Problems to be Solved by the Invention

The present invention has been completed in consideration of the problems of conventional technology described above, and aims at providing a network structure having excellent repeated compression durability, the network structure having a low repeated compression residual strain and a high hardness retention after repeated compression.

Means for Solving the Problems

The present invention has been completed as result of wholehearted investigation performed by the present inventors in order to solve the above-described problems. That is, the present invention includes:

1. A network structure comprising a three-dimensional random loop bonded structure obtained by forming random loops with curling treatment of a continuous linear structure including a polyester-based thermoplastic elastomer and having a fineness of not less than 100 dtex and not more than 60000 dtex, and by making each loop mutually contact in a molten state, wherein the network structure has an apparent density of 0.005 g/cm$^3$ to 0.20 g/cm$^3$, a 50%-constant displacement repeated compression residual strain of not more than 15%, and a 50%-compression hardness retention of not less than 85% after 50%-constant displacement repeated compression.
2. The network structure according to the above 1, wherein the network structure has a 25%-compression hardness retention of not less than 85% after 50%-constant displacement repeated compression.
3. The network structure according to the above 1 or 2, wherein the network structure has a thickness of not less than 10 mm and not more than 300 mm.
4. The network structure according to any one of the above 1 to 3, wherein the cross section of the continuous linear structure that forms the network structure is a hollow cross section and/or a modified cross section.
5. The network structure according to any one of the above 1 to 4, wherein the network structure has a hysteresis loss of not more than 28%.
6. The network structure according to any one of the above 1 to 5, wherein the network structure has a number of bonding points per unit weight of 60/g to 500/g.

Effect of the Invention

A network structure according to the present invention is a network structure having excellent repeated compression durability, the network structure having a low repeated compression residual strain and high hardness retention after repeated compression and hardly causing a change in sitting comfort and sleeping comfort even after repeated use. The excellent repeated compression durability has made it possible to provide a network structure suitable for cushioning materials that are used for office chairs, furniture, sofas, beddings such as beds, and seats for vehicles such as those for trains, automobiles, two-wheeled vehicles, buggies and child seats, and floor mats and mats for impact absorption such as members for prevention of collision and nipping, etc.

BRIEF DESCRIPTION OF THE DRAWINGS

FIG. 1 illustrates a schematic graph of a compression/decompression test in the hysteresis loss measurement of a network structure.

BEST MODE FOR CARRYING OUT THE INVENTION

Hereinafter, the present invention will be described in detail.

The network structure of the present invention is a network structure made of a three-dimensional random loop bonded structure obtained by forming random loops with curling treatment of a continuous linear structure including a polyester-based thermoplastic elastomer and having a fineness of not less than 100 dtex and not more than 60000 dtex, and by making each loop mutually contact in a molten state, wherein the network structure has an apparent density of 0.005 g/cm$^3$ to 0.20 g/cm$^3$, a 50%-constant displacement repeated compression residual strain of not more than 15%, and a 50%-compression hardness retention of not less than 85% after 50%-constant displacement repeated compression.

As the polyester-based thermoplastic elastomer in the present invention, a polyester ether block copolymer having a thermoplastic polyester as a hard segment and a polyalkylenediol as a soft segment or a polyester ester block copolymer having an aliphatic polyester as a soft segment may be mentioned as examples.

The polyester ether block copolymer is a triblock copolymer formed of at least one of dicarboxylic acids selected from aromatic dicarboxylic acids such as terephthalic acid, isophthalic acid, naphthalene-2,6-dicarboxylic acid, naphthalane-2,7-dicarboxylic acid and diphenyl-4,4'-dicarboxylic acid, cycloaliphatic dicarboxylic acids such as 1,4-cyclohexanedicarboxylic acid, aliphatic dicarboxylic acids such as succinic acid, adipic acid, sebacic acid and dimer acid and ester forming derivatives thereof: at least one of diol components selected from aliphatic diols such as 1,4-butanediol, ethylene glycol, trimethylene glycol, tetramethylene glycol, pentamethylene glycol and hexamethylene glycol and cycloaliphatic diols such as 1,1-cyclohexanedimethanol, 1,4-cyclohexanedimethanol and ester forming derivatives thereof; and at least one of polyalkylenediols such as glycols including polyethylene glycol, polypropylene glycol, polytetramethylene glycol or an ethylene oxide-propylene oxide copolymer, the number average molecular weight of which is about 300 to 5000.

The polyester ester block copolymer is a triblock copolymer formed of at least one of the above-described dicarboxylic acids, at least one of the above-described diols, and at least one of polyester diols such as polylactone, the number average molecular weight of which is about 300 to 5000. When considering heat adhesiveness, hydrolysis resistance, stretchability and heat resistance etc., triblock copolymers having terephthalic acid or naphthalene-2,6-dicarboxylic acid as a dicarboxylic acid, 1,4-butanediol as a diol component, and polytetramethylene glycol as a polyalkylenediol, or triblock copolymers having polylactone as a polyester diol are especially preferred. In special cases, those containing a polysiloxane-based soft segment may also be used.

The polyester-based thermoplastic elastomer in the present invention also encompasses those obtained by blending or copolymerizing a non-elastomer component with the polyester-based thermoplastic elastomer and those having a polyolefin-based component as a soft segment. Further, those obtained by adding various kinds of additives etc. to the polyester-based thermoplastic elastomer as necessary are also encompassed.

For achieving repeated compression durability of a network structure, which is an object of the present invention, the content of a soft segment in the polyester-based thermoplastic elastomer is preferably not less than 15% by weight, more preferably not less than 25% by weight, still more preferably not less than 30% by weight, especially preferably not less than 40% by weight, and for securing the hardness and from the viewpoint of heat and setting resistance, the content of a soft segment in the polyester-based thermoplastic elastomer is preferably not more than 80% by weight, more preferably not more than 70% by weight.

Preferably, a component including the polyester-based thermoplastic elastomer, which forms the network structure having excellent repeated compression durability of the present invention, has an endothermic peak at a temperature of not higher than the melting point in a melting curve obtained by measurement using a differential scanning calorimeter. Those having an endothermic peak at a temperature of not higher than the melting point have significantly improved heat and setting resistance as compared to those having no endothermic peak. For example, when, as the preferred polyester-based thermoplastic elastomer in the present invention, an acid component of hard segment containing terephthalic acid or naphthalene-2,6-dicarboxylic acid etc. having stiffness in an amount of not less than 90% by mol, the content of terephthalic acid or naphthalene-2,6-dicarboxylic acid being more preferably not less than 95% by mol, especially preferably 100% by mol, and a glycol component are subjected to transesterification, the resulting product is then polymerized to a necessary polymerization degree, and not less than 15% by weight and not more than 80% by weight, more preferably not less than 25% by weight and not more than 70% by weight, still more preferably not less than 30% by weight and not more than 70% by weight, especially preferably not less than 40% by weight and not more than 70% by weight of polytetramethylene glycol having an average molecular weight of not less than 500 and not more than 5000, more preferably not less than 700 and not more than 3000, still more preferably not less than 800 and not more than 1800 is then copolymerized, crystallinity of hard segment is improved, plastic deformation is hard to occur and heat and setting resistance is improved when the acid component of hard segment has a high content of terephthalic acid and naphthalene-2,6-dicarboxylic acid having stiffness. When annealing treatment is further performed at a temperature lower by at least 10° C. than the melting point after hot-melt bonding, heat and setting resistance is further improved. It suffices that the sample can be heat-treated at a temperature lower by at least 10° C. than the melting point in annealing treatment, but heat and setting resistance is further improved when a compressive strain is imparted. An endothermic peak appears more clearly at a temperature of not lower than room temperature and not higher than the melting point in a melting curve obtained by measuring the cushioning layer treated as described above using a differential scanning calorimeter. When annealing is not performed, an endothermic peak does not appear clearly in the melting curve at a temperature of not lower than room temperature and not higher than the melting point. From this, it can be thought that by annealing, a hard segment is rearranged to form a semi-stable intermediate phase, so that heat and setting resistance is improved. As an approach for utilizing the heat resistance improving effect in the present invention, use in applications supposed to involve a relatively high temperature, such as cushions for vehicles using a heater and flooring mats for heated floors, is effective because setting resistance is improved in those applications.

The fineness of the continuous linear structure which forms the network structure of the present invention should be set in a proper range because when the fineness is small, a necessary hardness cannot be maintained when the network structure is used as a cushioning material, and conversely when the fineness is excessively large, the hardness becomes excessively high. The fineness is not less than 100 dtex, preferably not less than 300 dtex. When the fineness is less than 100 dtex, the network structure becomes so thin that although denseness and soft touch are improved, it is difficult to secure a necessary hardness as a network structure. The fineness is not more than 60000 dtex, preferably not more than 50000 dtex. When the fineness is more than 60000, the hardness of the network structure can be sufficiently secured, but the network structure may become coarse, leading to deterioration of other cushioning performance.

The apparent density of the network structure of the present invention is 0.005 g/cm$^3$ to 0.20 g/cm$^3$, preferably 0.01 g/cm$^3$ to 0.18 g/cm$^3$, more preferably 0.02 g/cm$^3$ to 0.15 g/cm$^3$. When the apparent density is smaller than 0.005 g/cm$^3$, a necessary hardness cannot be maintained when the network structure is used as a cushioning material, and conversely when the apparent density is more than 0.20 g/cm$^3$, the hardness may become so high that the network structure is unsuitable for a cushioning material.

The thickness of the network structure of the present invention is preferably not less than 10 mm, more preferably not less than 20 mm. When the thickness is less than 10 mm, the network structure may be so thin that a bottoming feeling is given. The upper limit of the thickness is preferably not more than 300 mm, more preferably not more than 200 mm, still more preferably not more than 120 mm in view of manufacturing equipment.

The 70° C.-compression residual strain of the network structure of the present invention is preferably not more than 35%. When the 70° C.-compression residual strain is more than 35%, properties as a network structure to be used for an intended cushioning material are not satisfied.

The 50%-constant displacement repeated compression residual strain of the network structure of the present invention is not more than 15%, preferably not more than 10%. When the 50%-constant displacement repeated compression residual strain is more than 15%, the network structure is reduced in thickness after a long period of use, and is not preferred as a cushioning material. The lower limit of the 50%-constant displacement repeated compression residual strain is not particularly defined, but it is not less than 1% in the case of the network structure obtained in the present invention.

The 50%-compression hardness of the network structure of the present invention is preferably not less than 10 N/φ200 and not more than 1000 N/φ200. When the 50%-compression hardness is less than 10 N/φ200, a bottoming feeling may be given. When the 50%-compression hardness is more than 1000 N/φ200, the hardness may be so high that cushioning performance is impaired.

The 25%-compression hardness of the network structure of the present invention is preferably not less than 5 N/φ200 and not more than 500 N/φ200. When the 25%-compression hardness is less than 0.5 N/φ200, the hardness may be so low that cushioning performance may become insufficient. When the 25%-compression hardness is more than 500 N/φ200, the hardness may be so high that cushioning performance is impaired.

The 50%-compression hardness retention after 50%-constant displacement repeated compression of the network structure of the present invention is not less than 85%, preferably not less than 88%, more preferably not less than 90%. When the 50%-compression hardness retention after 50%-constant displacement repeated compression is less than 85%, a bottoming feeling may be given due to a decrease in hardness of a cushioning material with a long period of use. The upper limit of the 50%-compression hardness retention after 50%-constant displacement repeated compression is not particularly defined, but it is not more than 110% in the case of the network structure obtained in the present invention. The reason why the 50%-compression hardness retention may exceed 100% is that there may be cases where the thickness of the network structure is reduced due to repeated compression, so that the apparent density of the network structure after repeated compression is increased, leading to an increase in hardness of the network structure. When the hardness is increased due to repeated compression, cushioning performance is changed, and therefore the 50%-compression hardness retention is preferably not more than 110%.

The 25%-compression hardness retention after 50%-constant displacement repeated compression of the network structure of the present invention is preferably not less than 85%, more preferably not less than 88%, still more preferably not less than 90%, especially preferably not less than 93%. When the 25%-compression hardness retention after 50%-constant displacement repeated compression is less than 85%, the hardness of a cushioning material may be reduced with a long period of use, leading to a change in sitting comfort. The upper limit of the 25%-compression hardness retention after 50%-constant displacement repeated compression is not particularly defined, but it is not more than 110% in the network structure obtained in the present invention. The reason why the 25%-compression hardness retention may exceed 100% is that there may be cases where the thickness of the network structure is reduced due to repeated compression, so that the apparent density of the network structure after repeated compression is increased, leading to an increase in hardness of the network structure. When the hardness is increased due to repeated compression, cushioning performance is changed, and therefore the 25%-compression hardness retention is preferably not more than 110%.

The hysteresis loss of the network structure of the present invention is preferably not more than 28%, more preferably not more than 27%, still more preferably not more than 26%, still further more preferably not more than 25%. When the hysteresis loss is more than 28%, a large force of repulsion may be hardly felt when a user is seated. The lower limit of the hysteresis loss is not particularly defined, but it is preferably not less than 1%, more preferably not less than 5% in the case of the network structure obtained in the present invention. When the hysteresis loss is less than 1%, the force of repulsion is so large that cushioning performance is deteriorated, and therefore the hysteresis loss is preferably not less than 1%, more preferably not less than 5%.

The number of bonding points per unit weight of a random loop bonded structure that is the network structure of the present invention is preferably 60 to 500/g. The bonding point refers to a fused part between two filaments, and the number of bonding points per unit weight (unit: number of points/g) is a value obtained by dividing the number of bonding points per unit volume (unit: number of points/$cm^3$) in a parallelepiped-shaped piece by an apparent density of the piece (unit: g/$cm^3$), the parallelepiped-shaped piece being prepared by cutting a network structure into a parallelepiped shape such that the piece has a size of 5 cm (longitudinal direction)×5 cm (width direction), and includes two outermost layer surfaces of the sample, but does not include the edge of the sample. As a method for measuring the number of bonding points, the fused part is peeled apart by pulling two filaments, and the number of peelings is counted. In the case of a network structure having a belt-like density difference of not less than 0.005 g/$cm^3$ in terms of apparent density in the longitudinal direction or width direction of the sample, the sample is cut such that a boundary line between a dense part and a sparse part coincides with an intermediate line in the longitudinal direction or width direction of the piece, and the number of bonding points per unit weight is counted. When the number of bonding points per unit weight is in the above-described range, filaments are moderately restrained, so that a network structure is obtained which allows a moderate hardness and force of repulsion to be easily obtained and gives good sitting or sleeping comfort. The number of bonding points per unit weight of the network structure of the present invention is preferably not less than 60/g and not more than 500/g, more preferably not less than 80/g and not more than 450/g, still more preferably not less than 100/g and not more than 400/g. When the number of bonding points per unit weight of the network structure of the present invention is less than 60/g, the network structure may become so coarse that product quality is unsatisfactory, and when the number of bonding points per unit weight is more than 500/g, it may become difficult to secure a necessary hardness. In this text, the bonding point may be described as a contact point.

The network structure of the present invention has such properties that the 50%-compression hardness retention after 50%-constant displacement repeated compression is not less than 85% and the 25%-compression hardness retention after 50%-constant displacement repeated compression is not less than 85%. Only when the hardness retention is in the above-described range, a network structure is obtained which has a reduced change in hardness after a long period of use and which can be used for a long period of time with a small change in sitting or sleeping comfort. Previously known network structures having a low 50%-constant displacement repeated compressive strain and the network structure of the present invention are different in that in the network structure of the present invention, fusion of continuous linear structures that form the network structure is made strong to increase the strength of contact points between continuous linear structures. By increasing the strength of contact points between continuous linear structures that form the network structure, the hardness retention after 50%-constant displacement repeated compression of the network structure can be improved. That is, in the case of previously known network structures, many of contact points between continuous linear structures that form the network structure are ruptured due to 50%-constant displacement repeated compression, but in the case of the network structure of the present invention, rupture of the contact points can be reduced as compared to conventional network structures.

On the other hand, for the 50%-constant displacement repeated compressive strain, it is considered that even if contact points of the network structure after repeated compression are ruptured, the compressive strain is low because the thickness is restored due to elasticity of a polyester-based thermoplastic elastomer that forms continuous linear structures, and therefore conventional network structures have a 50%-constant displacement repeated compressive strain which is not much different from that of the network structure of the present invention.

The network structure of the present invention has such properties that the hysteresis loss is not more than 28%. Only when the hysteresis loss is in the above-described range, a network structure giving sitting or sleeping comfort with a large force of repulsion is obtained. In the network structure of the present invention, fusion of continuous linear structures that form a network structure is made strong to increase the strength of contact points between continuous linear structures. The mechanism of increasing the strength of contact points to reduce the hysteresis loss is complicated, and has not been fully cleared, but it can be presumed as follows. When the strength of contact points between continuous linear structures that form a network structure is increased, rupture of contact points is hard to occur when the network structure is compressed. Next, when stress is released from the compressed state and the network structure is restored from the deformed state, the contact points are not ruptured but maintained, and therefore restoration from the deformed state is accelerated to reduce the hysteresis loss. That is, it is considered that in previously known network structures, many of contact points between continuous linear structures that form a network structure are ruptured due to prescribed preliminary compression or second compression, but in the network structure of the present invention, rupture of contact points can be reduced as compared to the conventional network structures, and maintained contact points enable more effective use of rubber elasticity intrinsic to the polymer to be used.

The network structure of the present invention has such properties that the number of bonding points per unit weight is not less than 60/g and not more than 500/g. When the number of bonding points per unit weight is in the above-described range, a network structure combining quality and hardness is obtained. The number of bonding points per unit weight can be adjusted by the heat retaining mold distance, the nozzle surface-cooling water temperature, the spinning temperature, etc. Among them, provision of a heat retaining mold distance is preferred because the strength of contact points is increased. It is preferred to adjust the number of bonding points per unit weight by using one of the above-mentioned conditions alone or using those conditions in combination.

For example, the network structure of the present invention having a high hardness retention after 50%-constant displacement repeated compression is obtained in the following manner. The network structure is obtained in accordance with a publicly known method described in Japanese Patent Application No. H7-68061 A etc. For example, a polyester-based thermoplastic elastomer is distributed to nozzle orifices from a multi-row nozzle having a plurality of orifices, and discharged downward through the nozzle at a spinning temperature higher by not less than 20° C. and less than 120° C. than the melting point of the polyester-based thermoplastic elastomer, the continuous linear structures are mutually contacted in a molten state and thereby fused to form a three-dimensional structure, which is sandwiched by a take-up conveyor net, cooled by cooling water in a cooling bath, then drawn out, and drained or dried to obtain a network structure having both surfaces or one surface smoothed. When only one surface is to be smoothed, the polyester-based thermoplastic elastomer may be discharged onto an inclined take-up net, and the continuous linear structures may be mutually contacted in a molten state and thereby fused to form a three-dimensional structure, which may be cooled while the form of only the take-up net surface is relaxed. The obtained network structure can also be subjected to annealing treatment. Drying treatment of the network structure may be performed by annealing treatment.

For obtaining the network structure of the present invention, fusion of continuous linear structures of a network structure to be obtained should be made strong to increase the strength of contact points between the continuous linear structures. By increasing the strength of contact points between continuous linear structures that form the network structure, repeated compression durability of the network structure can be resultantly improved.

As one of means for obtaining a network structure with an increased strength of contact points, for example, a heat-retaining region is provided below a nozzle when a polyester-based thermoplastic elastomer is spun. It is also conceivable that the spinning temperature of the polyester-based thermoplastic elastomer is increased, but it is preferred to provide a heat-retaining region below a nozzle from the viewpoint of preventing heat degradation of the polymer. The length of the heat-retaining region below a nozzle is preferably not less than 20 mm, more preferably not less than 35 mm, still more preferably not less than 50 mm. The upper limit of the length of the heat-retaining region is preferably not more than 70 mm. When the length of the heat-retaining region is not less than 20 mm, fusion of continuous linear structures of a network structure to be obtained becomes strong, strength of contact points between continuous linear structures is increased, and resultantly repeated compression durability of the network structure can be improved. When the length of the heat-retaining region is less than 20 mm, the strength of contact points is not improved to the extent that satisfactory repeated compression durability can be achieved. When the length of the heat-retaining region is more than 70 mm, surface quality may be deteriorated.

For the heat-retaining region, a periphery of a spin pack or an amount of heat carried by the polymer may be used to form a heat-retaining region, or the temperature of a fiber-falling region immediately below a nozzle may be controlled by heating the heat-retaining region with a heater. For the heat-retaining region, a heat-retaining material may be provided so as to surround the circumference of falling continuous linear structures below the nozzle by using an iron plate, an aluminum plate, a ceramic plate etc. More preferably, the heat-retaining material is formed from the above-described materials, and these materials are covered with a heat-insulating material. As a position where the heat-retaining region is provided, the heat-retaining region is preferably provided downward from a position of not more than 50 mm below the nozzle, more preferably from a position of not more than 20 mm below the nozzle, still more preferably from immediately below the nozzle. As one of preferred embodiments, the periphery of an area immediately below the nozzle is surrounded by an aluminum plate with a length of 20 mm downward from immediately below the nozzle such that the aluminum plate does not come into contact with a string, thereby retaining heat, and further the aluminum plate is covered with a heat-retaining material.

As another means for obtaining a network structure having an increased strength of contact points, the net surface temperature of a take-up conveyor net is increased at or around the falling position of continuous linear structures, or the temperature of cooling water in a cooling bath is increased at or around the falling position of continuous linear structures. The surface temperature of the take-up conveyor net is preferably not less than 80° C., more preferably not less than 100° C. For keeping good peeling properties between the continuous linear structure and the conveyor net, the conveyor net temperature is preferably not more than the melting point of the polymer, more preferably lower by not more than 20° C. than the melting point. The temperature of cooling water is preferably not less than 80° C.

The continuous linear structure that forms the network structure of the present invention may be formed as a complex linear structure obtained by combination with other thermoplastic resins within the bounds of not impairing the object of the present invention. When the linear structure itself is complexed, examples of the complexed form include complex linear structures of sheath-core type, side-by-side type and eccentric sheath-core type.

The network structure of the present invention may be formed as a multilayered structure within the bounds of not impairing the object of the present invention. Examples of the multilayered structure include a structure in which the surface layer and the back surface layer are formed of linear structures having different finenesses and a structure in which the surface layer and the back surface layer are formed of structures having different apparent densities. Examples of the method for formation a multilayered structure include methods in which network structures are stacked on one after another, and fixed by side ground etc., melted and fixed by heating, bonded with an adhesive, or bound by sewing or a band.

The shape of the cross section of the continuous linear structure that forms the network structure of the present invention is not particularly limited, but when the cross section is a solid cross section, a hollow cross section, a round cross section, a modified cross section or a combination thereof, preferred compression resistance and touch characteristics can be imparted.

The network structure of the present invention can be processed into a molded article from a resin manufacture process within the bounds of not deteriorating performance, and treated or processed by addition of chemicals, etc. to impart functions such as antibacterial deodorization, deodorization, mold prevention, coloring, fragrance, flame resisting, and absorption and desorption of moisture.

The network structure of the present invention thus obtained has excellent repeated compression durability with a low repeated compression residual strain and a high hardness retention.

Although the present invention will be described in detail with reference to examples, the present invention is in no way limited to them. Measurement and evaluation of characteristic value in examples were performed by following methods.

(1) Fineness

A specimen was cut into a size of 20 cm×20 cm, and sample was taken from 10 places. The linear structures sampled at 10 places were measured for a specific gravity at 40° C. using a density gradient tube. Furthermore, the linear structure sampled at the above-mentioned 10 places was measured for a cross-section area in a photograph magnified by 30 times under microscope to calculate a volume for a 10000 m of length of the linear structure. The product of a specific gravity and the volume obtained represents fineness (weight for 10000 m of the linear structure). (Average of n=10)

(2) Sample Thickness and Apparent Density

A sample is cut into a size of 30 cm×30 cm, the cut sample is kept standing with no load for 24 hours, and then measured for the height at 4 points using a thickness gauge Model FD-80N manufactured KOBUNSHI KEIKI CO., LTD., and the average of the measured values is determined as the sample thickness. The sample weight is measured by placing the sample on an electronic balance. The volume is determined from the sample thickness, and the sample weight is divided by the volume to obtain a value as the apparent density (average of n=4 in each case).

(3) Melting Point (Tm)

An endothermic peak (melting peak) temperature was determined from an endothermic/exothermic curve obtained by measurement at a heating rate of 20° C./min using a differential scanning calorimeter Q200 manufactured by TA Instruments.

(4) 70° C.-Compression Residual Strain

A sample is cut into a size of 30 cm×30 cm, and the cut sample is measured for a thickness (a) before treatment using the method described in (2). The sample, whose thickness has been measured, is sandwiched in a tool capable of being held in a 50%-compression state, placed in a dryer set at 70° C., and kept standing for 22 hours. Thereafter, the sample is taken out, and cooled to remove a compressive strain, a thickness (b) after standing for 1 day is determined, and the compression residual strain is calculated in accordance with the formula: {(a)−(b)}/(a)×100 from the thickness (b) and the thickness (a) before treatment (unit: %) (average of n=3).

(5) 25%- and 50%-Compression Hardness

A sample is cut into a size of 30 cm×30 cm, and the cut sample is kept standing under an environment of 20° C.±2° C. with no load for 24 hours, the central part of the sample is then compressed at a speed of 100 mm/min with a φ200 mm compression board having a thickness of 3 mm using a tensilon manufactured by ORIENTEC Co., LTD., which is placed under an environment of 20° C.±2° C., and the thickness at a load of 5 N is measured as a hardness-meter thickness. The position of the compression board at this time is defined as a zero position, and the sample is compressed to 75% of the hardness-meter thickness at a speed of 100 mm/min, followed by returning the compression board to the zero point at a speed of 100 mm/min. Subsequently, the sample is compressed to 25% and 50% of the hardness-meter thickness at a speed of 100 mm/min, and loads at this time are measured as a 25%-compression hardness and a 50%-compression hardness, respectively (unit: N/φ 200) (average of n=3).

(6) 50%-Constant Displacement Repeated Compression Residual Strain

A sample is cut into a size of 30 cm×30 cm, and the cut sample is measured for a thickness (a) before treatment using the method described in (2). The sample, whose thickness has been measured, is repeatedly compressed to a thickness of 50% and restored in a cycle of 1 Hz under an environment of 20° C.±2° C. using Servopulser manufactured by Shimadzu Corporation, the sample after 80000 times of repetition is kept standing for 1 day, followed by determining a thickness (b) after treatment, and the 50%-constant displacement repeated compression residual strain is calculated in accordance with the formula: {(a)−(b)}/(a)×100 from the thickness (b) and the thickness (a) before treatment (unit: %) (average of n=3).

(7) 50%-Compression Hardness Retention after 50%-Constant Displacement Repeated Compression A sample is cut into a size of 30 cm×30 cm, and the cut sample is measured for the thickness before treatment using the method described in (2). The sample, whose thickness has been measured, is measured using the method described in (5), and the obtained 50%-compression hardness is defined as a load (a) before treatment. Thereafter, the sample is repeatedly compressed to 50% of the thickness before treatment and restored in a cycle of 1 Hz under an environment of 20° C.±2° C. using Servopulser manufactured by Shimadzu Corporation, the sample after 80000 times of repetition is kept standing for 30 minutes, and then measured using the method described in (5), and the obtained 50% compression hardness is defined as a load (b) after treatment. The 50%-compression hardness retention after 50%-constant displacement repeated compression is calculated in accordance with the formula: (b)/(a)×100 (unit: %) (average of n=3).

(8) 25%-Compression Hardness Retention after 50%-Constant Displacement Repeated Compression A sample is cut into a size of 30 cm×30 cm, and the cut sample is measured for the thickness before treatment using the method described in (2). The sample, whose thickness has been measured, is measured using the method described in (5), and the obtained 25%-compression hardness is defined as a load (c) before treatment. Thereafter, the sample is repeatedly compressed to 50% of the thickness before treatment and restored in a cycle of 1 Hz under an environment of 20° C.±2° C. using Servopulser manufactured by Shimadzu Corporation, the sample after 80000 times of repetition is kept standing for 30 minutes, and then measured using the method described in (5), and the obtained 25%-compression hardness is defined as a load (d) after treatment. The 25%-compression hardness retention after 50%-constant displacement repeated compression is calculated in accordance with the formula: (d)/(c)×100 (unit: %) (average of n=3).

(9) Hysteresis Loss

A sample is cut into a size of 30 cm×30 cm, and the cut sample is kept standing under an environment of 20° C.±2° C. with no load for 24 hours, the central part of the sample is then compressed at a speed of 10 mm/min with a φ200 mm compression board having a thickness of 3 mm using a tensilon manufactured by ORIENTEC Co., LTD., which is placed under an environment of 20° C.±2° C., and the thickness at a load of 5 N is measured as a hardness-meter thickness. The position of the compression board at this time is defined as a zero position, the sample is compressed to 75% of the hardness-meter thickness at a speed of 100 mm/min, and the compression board is returned to the zero position at the same speed without hold time (first stress strain curve). Subsequently the sample is compressed to 75% of the hardness-meter thickness at a speed of 100 mm/min without hold time, and the compression board is returned to the zero position at the same speed without hold time (second stress strain curve). The compression energy given by the second compression stress curve is defined as WC, and the compression energy given by the second decompression stress curve is defined as WC'. The hysteresis loss is determined in accordance with the following equation.

$$\text{Hysteresis loss}(\%)=(WC-WC')/WC\times 100$$

$WC=\int PdT$ (workload at compression from 0% to 75%)

$WC'=\int PdT$ (workload at decompression from 75% to 0%)

In a simplified manner, the hysteresis loss may be determined by data analysis with a personal computer when a stress strain curve as shown in, for example, FIG. 1 is obtained. Further, the area drawn in oblique lines is defined as WC and the area drawn in net-like lines is defined as WC'. Each area of a paper with each curve drawn thereon is cut out to be measured for a weight, and the target value may be obtained from each of the weight (average of n=3).

(10) Number of Bonding Points Per Unit Weight

First, a piece was prepared by cutting a sample in a parallelepiped shape such that the piece had a size of 5 cm (longitudinal direction)×5 cm (width direction), and included two outermost layer surfaces of the sample, but did not include the edge of the sample. Next, heights at 4 corners of the piece were measured, the volume (unit: $cm^3$) was then determined, and the weight (unit: g) of the sample was divided by the volume to calculate the apparent density (unit: $g/cm^3$). Next, the number of bonding points in the piece was counted, the number was divided by the volume of the piece to calculate the number of bonding points per unit volume (unit: number/$cm^3$), and the number of bonding points per unit volume was divided by the apparent density to calculate the number of bonding points per unit weight (unit: number/g). A fused part between two filaments was defined as the bonding point, and the number of bonding points was counted by a method of peeling apart a fused part by pulling two filaments. The number of bonding points per unit weight was determined as an average of n=2. In the case of a sample having a belt-like density difference of not less than 0.005 $g/cm^3$ in terms of apparent density in the longitudinal direction or width direction of the sample, the sample was cut such that a boundary line between a dense part and a sparse part coincided with an intermediate line in the longitudinal direction or width direction of the piece, and the number of bonding points per unit weight was measured by a similar method (n=2).

EXAMPLES

Example 1

As a polyester-based elastomer, dimethyl terephthalate (DMT) and 1,4-butanediol (1,4-BD) were charged together with a small amount of a catalyst, transesterification was performed using a usual method, polytetramethylene glycol (PTMG) was then added, and the mixture was subjected to polycondensation while the temperature was raised and the pressure was reduced, so that a polyether ester block copolymer elastomer was generated. Then, 2% of an antioxidant was added thereto, and the mixture was mixed and kneaded, then pelletized, and dried in vacuum at 50° C. for 48 hours to obtain a thermoplastic elastic resin raw material. The formulation of the obtained thermoplastic elastic resin raw material is shown in Table 1.

The obtained thermoplastic elastic resin (A-1) was discharged to downward from a nozzle at a melting temperature of 230° C. and a speed of 2.4 g/min in terms of discharge amount per single hole through orifices zigzag-arranged at a pitch between holes of 5 mm on a nozzle effective face of 1050 mm in the width direction and 45 mm in width in the thickness direction, each orifice shaped to have an outer diameter of 2 mm, an inner diameter of 1.6 mm and have a triple bridge hollow forming cross section. Cooling water of 30° C. was arranged at a position 28 cm below the nozzle face through a heat-retaining region provided immediately below the nozzle with a length of 30 mm. Endless nets made of stainless steel each having a width of 150 cm were disposed parallel at an interval of 40 mm in opening width to form a pair of take-up conveyors so as to be partially exposed over a water surface. The conveyor nets over the water surface were not heated with an infrared heater, and the discharged filaments in a molten state were curled to form loops on the net having a surface temperature of 40° C., and contact parts were fused to form a three-dimensional network structure. The network in a molten state was sandwiched at both surfaces by the take-up conveyors, and drawn into cooling water at 30° C. at a speed of 1.2 m per minute, thereby solidified, flattened at both surfaces, then cut into a predetermined size, and dried/heat-treated with hot air at 110° C. for 15 minutes to obtain a network structure. The properties of the obtained network structure formed of a thermoplastic elastic resin are shown in Table 2.

The obtained network was formed of filaments each having a triangular prism-shaped hollow cross section as a cross-sectional shape, and having a hollowness of 34% and a fineness of 3300 dtex, and had an apparent density of 0.038 $g/cm^3$, a thickness of flattened surface of 38 mm, a 70° C.-compression residual strain of 12.2%, a 50%-constant displacement repeated compression residual strain of 3.3%, a 25%-compression hardness of 128 N/φ200 mm, a 50%-compression hardness of 241 N/φ200 mm, a 50%-compression hardness retention of 90.5% after 50%-constant displacement repeated compression, a 25%-compression hardness retention of 90.8% after 50%-constant displacement repeated compression, a hysteresis loss of 27.2%, and a number of bonding points per unit weight of 134.41/g. The properties of the obtained network structure are shown in Table 2. The obtained network structure satisfied the requirements of the present invention, and had excellent repeated compression durability.

Example 2

A network structure was obtained in the same manner as in Example 1 except that a heat-retaining region was not provided immediately below the nozzle, the discharge amount per single hole was 4 g/min, the take-up speed was 1.5 m/min, the nozzle face-cooling water distance was 28 cm, endless nets made of stainless steel having a width of 150 cm were disposed parallel at an interval of 41 mm in opening width, and the surfaces of the conveyor nets were heated to 120° C. with an infrared heater. The obtained network structure was formed of filaments each having a triangular prism-shaped hollow cross section as a cross-sectional shape, and having a hollowness of 35% and a fineness of 2800 dtex, and had an apparent density of 0.052 $g/cm^3$, a thickness of flattened surface of 41 mm, a 70° C.-compression residual strain of 18.6%, a 50%-constant displacement repeated compression residual strain of 2.9%, a 25%-compression hardness of 220 N/φ200 mm, a 50%-compression hardness of 433 N/φ200 mm, a 50%-compression hardness retention of 99.6% after 50%-constant displacement repeated compression, a 25%-compression hardness retention of 92.8% after 50%-constant displacement repeated compression, a hysteresis loss of 26.5%, and a number of bonding points per unit weight of 322.21/g. The properties of the obtained network structure are shown in Table 2. The obtained cushion satisfied the requirements of the present invention, and the obtained network structure had excellent repeated compression durability.

Example 3

A network structure was obtained in the same manner as in Example 1 except that a heat-retaining region was not provided immediately below the nozzle, the spinning temperature was 230° C., the discharge amount per single hole was 2.8 g/min, endless nets made of stainless steel having a width of 150 cm were disposed parallel at an interval of 36 mm in opening width, the conveyor nets were not heated, the surface temperature thereof was 40° C., and the temperature of cooling water was 80° C. The obtained network structure was formed of filaments each having a triangular prism-shaped hollow cross section as a cross-sectional shape, and having a hollowness of 30% and a fineness of 3000 dtex, and had an apparent density of 0.043 g/cm$^3$, a thickness of flattened surface of 35 mm, a 70° C.-compression residual strain of 17.9%, a 50%-constant displacement repeated compression residual strain of 4.4%, a 25%-compression hardness of 155 N/φ200 mm, a 50%-compression hardness of 271 N/φ200 mm, a 50% compression hardness retention of 93.9% after 50%-constant displacement repeated compression, a 25%-compression hardness retention of 90.3% after 50%-constant displacement repeated compression, a hysteresis loss of 27.0%, and a number of bonding points per unit weight of 237.5/g. The properties of the obtained network structure are shown in Table 2. The obtained cushion satisfied the requirements of the present invention, and the obtained network structure had excellent repeated compression durability.

Example 4

A network structure was obtained in the same manner as in Example 1 except that a resin A-2 was used as a thermoplastic elastic resin, a heat-retaining region was provided immediately below the nozzle with a length of 30 mm, the spinning temperature was 210° C., the discharge amount per single hole was 2.5 g/min, the take-up speed was 0.8 m/min, the nozzle face-cooling water distance was 32 cm, the conveyor nets were not heated, the surface temperature thereof was 40° C., and the temperature of cooling water was 30° C. The obtained network structure was formed of filaments each having a triangular prism-shaped hollow cross section as a cross-sectional shape, and having a hollowness of 30% and a fineness of 3200 dtex, and had an apparent density of 0.060 g/cm$^3$, a thickness of flattened surface of 37 mm, a 70° C.-compression residual strain of 13.1%, a 25%-compression hardness of 61 N/φ200 mm, a 50%-compression hardness of 148 N/φ200 mm, a 50%-constant displacement repeated compression residual strain of 7.4%, a 50%-compression hardness retention of 102.8% after 50%-constant displacement repeated compression, a 25%-compression hardness retention of 93.3% after 50%-constant displacement repeated compression, a hysteresis loss of 26.1%, and a number of bonding points per unit weight of 164.9/g. The properties of the obtained network structure are shown in Table 2. The obtained cushion satisfied the requirements of the present invention, and the network structure had excellent repeated compression durability.

Example 5

A network structure was obtained in the same manner as in Example 1 except that a resin A-3 was used as a thermoplastic elastic resin, a heat-retaining region was provided immediately below the nozzle with a length of 30 mm, the spinning temperature was 210° C., the discharge amount per single hole was 2.6 g/min, the take-up speed was 0.8 m/min, the nozzle face-cooling water distance was 35 cm, the conveyor nets were not heated, the surface temperature thereof was 40° C., and the temperature of cooling water was 30° C. The obtained network structure was formed of filaments each having a triangular prism-shaped hollow cross section as a cross-sectional shape, and having a hollowness of 30% and a fineness of 2800 dtex, and had an apparent density of 0.061 g/cm$^3$, a thickness of flattened surface of 36 mm, a 70° C.-compression residual strain of 14.1%, a 25%-compression hardness of 56 N/φ200 mm, a 50%-compression hardness of 150 N/φ200 mm, a 50%-constant displacement repeated compression residual strain of 6.9%, a 50%-compression hardness retention of 93.8% after 50%-constant displacement repeated compression, a 25% compression hardness retention of 90.0% after 50%-constant displacement repeated compression, a hysteresis loss of 22.4%, and a number of bonding points per unit weight of 361.1/g. The properties of the obtained network structure are shown in Table 2. The obtained cushion satisfied the requirements of the present invention, and the network structure had excellent repeated compression durability.

Example 6

A network structure was obtained in the same manner as in Example 1 except that a resin A-1 was used as a thermoplastic elastic resin, a heat-retaining region was provided immediately below the nozzle with a length of 50 mm, the spinning temperature was 210° C., the discharge amount per single hole was 2.6 g/min, the take-up speed was 1.2 m/min, the nozzle face-cooling water distance was 25 cm, the conveyor nets were not heated, the surface temperature thereof was 40° C., and the temperature of cooling water was 30° C. The obtained network structure was formed of filaments each having a triangular prism-shaped hollow cross section as a cross-sectional shape, and having a hollowness of 30% and a fineness of 3500 dtex, and had an apparent density of 0.041 g/cm$^3$, a thickness of flattened surface of 35 mm, a 70° C.-compression residual strain of 9.3%, a 25%-compression hardness of 148 N/φ200 mm, a 50%-compression hardness of 258 N/φ200 mm, a 50%-constant displacement repeated compression residual strain of 4.1%, a 50%-compression hardness retention of 95.3% after 50%-constant displacement repeated compression, a 25% compression hardness retention of 96.4% after 50%-constant displacement repeated compression, a hysteresis loss of 27.6%, and a number of bonding points per unit weight of 87.6/g. The properties of the obtained network structure are shown in Table 2. The obtained cushion satisfied the requirements of the present invention, and the network structure had excellent repeated compression durability.

Comparative Example 1

A network structure was obtained in the same manner as in Example 1 except that the resin A-1 was used as a thermoplastic elastic resin, the spinning temperature was 210° C., a heat-retaining region immediately below the nozzle was eliminated, the discharge amount per single hole was 2.6 g/min and the nozzle face-cooling water distance was 30 cm. The obtained network structure was formed of filaments each having a triangular prism-shaped hollow cross section as a cross-sectional shape, and having a hollowness of 33% and a fineness of 3600 dtex, and had an apparent density of 0.037 g/cm$^3$, a thickness of flattened surface of 40 mm, a 70° C.-compression residual strain of 18.9%, a 25%-compression hardness of 111 N/φ200 mm, a 50%-compression hardness of 228 N/φ200 mm, a 50%-constant displacement repeated compression residual strain of 3.2%, a 50% compression hardness retention of 82.9% after 50%-constant displacement repeated compression, a 25% compression hardness retention of 75.7% after 50%-constant displacement repeated compression and a hysteresis loss of 30.4%. The properties of the obtained network structure are shown in Table 2. The obtained cushion did not satisfy the requirements of the present invention, and the network structure had poor repeated compression durability.

Comparative Example 2

A network structure was obtained in the same manner as in Example 1 except that the resin A-2 was used as a thermoplastic elastic resin, the spinning temperature was 200° C., a heat-retaining region immediately below the nozzle was eliminated, the discharge amount per single hole was 2.4 g/min, and the nozzle face-cooling water distance was 34 cm, and the take-up speed was 0.8 m/min. The obtained network structure was formed of filaments each having a triangular prism-shaped hollow cross section as a cross-sectional shape, and having a hollowness of 34% and a fineness of 3000 dtex, and had an apparent density of 0.059 g/cm$^3$, a thickness of flattened surface of 38 mm, a 70° C.-compression residual strain of 16.7%, a 25%-compression hardness of 59 N/φ200 mm, a 50%-compression hardness of 144 N/φ200 mm, a 50%-constant displacement repeated compression residual strain of 8.2%, a 50%-compression hardness retention of 82.9% after 50%-constant displacement repeated compression, a 25%-compression hardness retention of 84.2% after 50%-constant displacement repeated compression and a hysteresis loss of 29.1%. The properties of the obtained network structure are shown in Table 2. The obtained cushion did not satisfy the requirements of the present invention, and the network structure had poor repeated compression durability.

TABLE 1

| Experimental No. | Hard segment: Component | Hard segment: Grycol component | Soft segment: Component | Soft segment: Number average molecular weight | Soft segment: Content | Melting point (° C.) |
|---|---|---|---|---|---|---|
| A-1 | DMT | 1,4-BD | PTMG | 1000 | 28 | 205 |
| A-2 | DMT | 1,4-BD | PTMG | 1000 | 58 | 162 |
| A-3 | DMT | 1,4-BD | PTMG | 2000 | 52 | 166 |

TABLE 2

| | Example 1 | Example 2 | Example 3 | Example 4 | Example 5 | Example 6 | Comparative Example 1 | Comparative Example 2 |
|---|---|---|---|---|---|---|---|---|
| Thermoplastic Elastic Resin | A-1 | A-1 | A-1 | A-2 | A-3 | AA-1 | A-1 | A-2 |
| Spinning Temperature (° C.) | 230 | 230 | 230 | 210 | 210 | 210 | 210 | 200 |
| Heat retaining distance (mm) | 30 | 0 | 0 | 30 | 30 | 50 | 0 | 0 |
| Discharge amount per single hole (g/min) | 2.4 | 4 | 2.8 | 2.5 | 2.6 | 2.6 | 2.6 | 2.4 |
| Take-up speed (m/min) | 1.2 | 1.5 | 1.2 | 0.8 | 0.8 | 1.2 | 1.2 | 0.8 |
| Nozzle face-cooling water distance(cm) | 28 | 28 | 28 | 32 | 35 | 25 | 30 | 34 |
| Conveyor nets temperature (° C.) | 40 | 120 | 40 | 40 | 40 | 40 | 40 | 40 |
| Temperature of cooling water (° C.) | 30 | 30 | 80 | 30 | 30 | 30 | 30 | 30 |
| Apparent density (g/cm$^2$) | 0.038 | 0.052 | 0.043 | 0.080 | 0.081 | 0.041 | 0.037 | 0.059 |
| Thickness (mm) | 38 | 41 | 35 | 37 | 36 | 35 | 40 | 38 |
| Fineness (dtex) | 3300 | 2800 | 3000 | 3200 | 2800 | 3500 | 3600 | 3000 |
| 70° C.-compression residual strain (%) | 12.2 | 18.8 | 17.9 | 13.1 | 14.1 | 8.3 | 18.9 | 15.7 |
| 50%-constant displacement repeated compression residual strain (%) | 3.3 | 2.9 | 4.4 | 7.4 | 8.9 | 4.1 | 3.2 | 8.2 |
| 25%-compression hardness (N/φ 200) | 128 | 220 | 155 | 61 | 56 | 148 | 111 | 59 |
| 50%-compression hardness (N/φ 200) | 241 | 433 | 271 | 148 | 150 | 258 | 228 | 144 |
| 50%-compression hardness retention after 50%-constant displacement repeated compression (%) | 90.5 | 99.6 | 93.9 | 102.8 | 93.8 | 95.3 | 82.9 | 82.9 |
| 25%-compression hardness retention after 50%-constant displacement repeated compression (%) | 90.8 | 92.8 | 90.3 | 93.3 | 90.0 | 96.4 | 75.7 | 84.2 |
| Hysteresis loss (%) | 27.2 | 26.5 | 27.0 | 26.1 | 22.4 | 27.6 | 30.4 | 29.1 |
| Number of bonding points per unit weight (number/g) | 134.4 | 322.2 | 237.5 | 164.9 | 361.1 | 87.6 | — | — |

INDUSTRIAL APPLICABILITY

The present invention provides a network structure in which durability after repeated compression, which has been not satisfied by conventional products, is improved without deteriorating good sitting comfort and air permeability which have given heretofore by network structures. There can be provided a network structure suitable for cushioning materials that are used for office chairs, furniture, sofas, beddings such as beds, seats for vehicles such as those for trains, automobiles, two-wheeled vehicles, buggies and child seats, and floor mats and mats for impact absorption such as members for prevention of collision and nipping, etc, the network structure having a small reduction in thickness and a small reduction in hardness after a long period of use. For this reason, the network structure of the present invention significantly contributes to industries.

The invention claimed is:

1. A process for producing a network structure comprising:

distributing a polyester-based thermoplastic elastomer to nozzle orifices from a multi-row nozzle having a plurality of orifices, discharging the polyester-based thermoplastic elastomer downward through the nozzle at a spinning temperature higher by not less than 20° C. and less than 120° C. than the melting point of the polyester-based thermoplastic elastomer to form continuous linear structures, contacting the continuous linear structures each other in a molten state and thereby fusing the continuous linear structures to form a three-dimensional structure, providing a heat-retaining region below the nozzle when the polyester-based thermoplastic elastomer is spun, sandwiching the three-dimensional structure with a take-up conveyor net, cooling the three-dimensional structure with cooling water in a cooling bath, drawing out the three-dimensional structure, draining or drying the three-dimensional structure to obtain the network structure having both surfaces or one surface smoothed, wherein a length of the heat-retaining region is 20 mm or more, the heat-retaining region is provided downward from a position of not more than 50 mm immediately below the nozzle, the network structure has a 50%-constant displacement repeated compression residual strain after 80000 times of repetition of not more than 15%, and the network structure has a 50%-compression hardness retention after 50%-constant displacement repeated compression of not less than 85%.

2. A process for producing a network structure comprising:

distributing a polyester-based thermoplastic elastomer to nozzle orifices from a multi-row nozzle having a plurality of orifices, discharging the polyester-based thermoplastic elastomer downward through the nozzle at a spinning temperature higher by not less than 20° C. and less than 120° C. than the melting point of the polyester-based thermoplastic elastomer to form continuous linear structures, contacting the continuous linear structures each other in a molten state and thereby fusing the continuous linear structures to form a three-dimensional structure, sandwiching the three-dimensional structure with a take-up conveyor net disposed so as to be partially exposed over a water surface, cooling the three-dimensional structure with cooling water in a cooling bath, drawing out the three-dimensional structure, draining or drying the three-dimensional structure to obtain the network structure having both surface or one surface smoothed, wherein a net surface temperature of the take-up conveyor net over the water surface at or around a fiber-falling region is not less than 80° C., the network structure has a 50%-constant displacement repeated compression residual strain after 80000 times of repetition of not more than 15%, and the network structure has a 50%-compression hardness retention after 50%-constant displacement repeated compression of not less than 85%.

3. A process for producing a network structure comprising:

distributing a polyester-based thermoplastic elastomer to nozzle orifices from a multi-row nozzle having a plurality of orifices, discharging the polyester-based thermoplastic elastomer downward through the nozzle at a spinning temperature higher by not less than 20° C. and less than 120° C. than the melting point of the polyester-based thermoplastic elastomer to form continuous linear structures, contacting the continuous linear structures each other in a molten state and thereby fusing the continuous linear structures to form a three-dimensional structure, sandwiching the three-dimensional structure with a take-up conveyor net, cooling the three-dimensional structure with cooling water in a cooling bath, drawing out the three-dimensional structure, draining or drying the three-dimensional structure to obtain the network structure having both surface or one surface smoothed, wherein a temperature of the cooling water in the cooling bath at or around a fiber-falling region is not less than 80° C., and a nozzle face-cooling water distance is 25 cm to 35 cm, the network structure has a 50%-constant displacement repeated compression residual strain after 80000 times of repetition of not more than 15%, and the network structure has a 50%-compression hardness retention after 50%-constant displacement repeated compression of not less than 85%.

* * * * *